US007174870B2

(12) United States Patent
Rutsey

(10) Patent No.: US 7,174,870 B2
(45) Date of Patent: Feb. 13, 2007

(54) VALVE TRAIN OF AN INTERNAL COMBUSTION ENGINE COMPRISING A TAPPET AND A HOLLOW TAPPET PUSHROD

(75) Inventor: Cathleen Rutsey, Ferndale, MI (US)

(73) Assignee: Ina-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/294,254

(22) Filed: Dec. 5, 2005

(65) Prior Publication Data

US 2006/0130793 A1 Jun. 22, 2006

Related U.S. Application Data

(60) Provisional application No. 60/637,272, filed on Dec. 17, 2004.

(51) Int. Cl.
*F01L 1/14* (2006.01)

(52) U.S. Cl. ..... 123/90.61; 123/90.15; 123/90.62; 123/90.63

(58) Field of Classification Search ..... 123/90.61, 123/90.15, 90.63, 90.62
See application file for complete search history.

(56) References Cited

U.S. PATENT DOCUMENTS 3,144,010 A 8/1964 Van Slooten
3,418,983 A * 12/1968 Hans-Jurgen ..... 123/90.63
4,602,597 A * 7/1986 Rhoads ..... 123/90.15

FOREIGN PATENT DOCUMENTS

DE 19 83 334 U 4/1968
DE 1 992 038 8/1968
DE 33 43 324 A1 6/1984
DE 10 2004 019 282 A1 12/2005

* cited by examiner

*Primary Examiner*—Thomas Denion
*Assistant Examiner*—Zelalem Eshete
(74) *Attorney, Agent, or Firm*—Charles A. Muserlian

(57) ABSTRACT

A valve train of an internal combustion engine comprising a tappet and a hollow tappet pushrod that is actuated by said tappet, said tappet pushrod comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod, and the second support comprising a passage for the hydraulic medium to the follower member, wherein a one-way valve body is arranged in the interior of the tappet pushrod and extends for free axial displacement between a complementary valve seat facing the first support and a stop for the one-way valve body, typically a disc, facing the second support, which stop comprises at least one through-opening such that, when the one-way valve body comes to bear against the stop, a choked flow of hydraulic medium takes place toward the second support.

12 Claims, 3 Drawing Sheets

VALVE TRAIN OF AN INTERNAL COMBUSTION ENGINE COMPRISING A TAPPET AND A HOLLOW TAPPET PUSHROD

The application claims the benefit of provisional patent application Ser. No. 60/637,272 filed Dec. 17, 2004.

FIELD OF THE INVENTION

The invention concerns a valve train of an internal combustion engine comprising a tappet and a hollow tappet pushrod that is actuated by said tappet, said tappet pushrod comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod, and the second support comprising a passage for the hydraulic medium to the follower member.

BACKGROUND OF THE INVENTION

A valve train of the pre-cited type is disclosed in U.S. Pat. No. 6,196,175 B1. The tappet of this valve train is configured as a switchable roller tappet and is installed in a relatively strongly restricted mounting space, so that only an inadequate quantity of hydraulic medium can be contained in its pressure piston. However, in various situations such as upon re-firing of the internal combustion engine after a longer standstill, "taxi operation" etc., this hydraulic medium proves to be insufficient for a proper lash adjusting operation of the lash adjuster. Therefore, a relatively high risk of a re-aspiration of air into the high pressure chamber of the lash adjuster exists with all the drawbacks, like rattling noises, wear etc., known in the technical field.

Moreover, it is usual in OHV trains comprising a roller tappet and a tappet pushrod to lubricate further components like rocker arms, cam-contacting surfaces etc. that are situated at a high geodetic level, through a hollow tappet pushrod. This is also disclosed in the pre-cited U.S. Pat. No. 6,196,175, while U.S. Pat. No. 3,908,615 likewise discloses a hollow tappet pushrod. Further, U.S. Pat. No. 5,351,662 shows a tappet configured as a roller tappet in which it can be seen that, for design reasons, the hydraulic lash adjuster can contain only a very small quantity of hydraulic medium.

OBJECTS OF THE INVENTION

It is an object of the invention to provide a valve train of the pre-cited type in which the aforesaid drawbacks are eliminated.

This and other objects and advantages of the invention will become obvious from the following detailed description.

SUMMARY OF THE INVENTION

The invention achieves the above objects by the fact that a one-way valve body is arranged in the interior of the tappet pushrod and extends for free axial displacement between a complementary valve seat facing the first support and a stop for the one-way valve body, typically a disc, facing the second support, which stop comprises at least one through-opening such that, when the one-way valve body comes to bear against the stop, a choked flow of hydraulic medium takes place toward the second support.

In this way, the initially mentioned drawbacks are effectively eliminated. Thus, when the internal combustion engine is switched off, the oil accumulated in the interior of the tappet pushrod is retained as an additional reserve. When the internal combustion engine is started, this hydraulic medium can be released by the vibrations of the internal combustion engine occurring at starting and can flow into the reservoir of the pressure piston.

The means of the invention can equally well be arranged in an upper region of the tappet pushrod facing the second support or in a lower region facing the first support. In the first of these arrangements, the hydraulic medium situated under the means is retained after the principle of a pipette. In the second case, the means of the invention effects, above all, an accumulation of the hydraulic medium situated above the means in the tappet pushrod. If necessary, the proposed means may also be arranged in a central region of the tappet pushrod.

The scope of protection of the invention also extends to a solution in which the tappet pushrod, although used as an additional oil reservoir, does not serve as a passage for routing hydraulic medium to a follower member such as a rocker arm.

The one-way valve body is preferably a ball, such as, for example, a very inexpensive rolling bearing ball. If necessary, however, a conical or plate-like configuration of the one-way valve body is also feasible, with an appropriate adaptation of the valve seat.

Due to the hydraulic medium that flows additionally into the reservoir of the pressure piston out of the tappet pushrod immediately after starting of the internal combustion engine, the initially described rattling noises are avoided. Even during so-called "taxi operation", i.e. during extreme short-distance driving, it is guaranteed that a sufficient quantity of hydraulic medium always accumulates in the reservoir, so that a re-aspiration of air is avoided or at least clearly reduced compared to the prior art.

Except for the two end supports, the proposed tappet pushrod can have a one-piece structure, but a multi-piece structure, for example, of several inter-inserted individual sections is also possible. The supports are advantageously configured as ball heads. In place of ball-headed supports, supports with other configurations, such as pan-shaped, cylindrically arched etc., will also occur to a person skilled in the art.

Thus, when the internal combustion engine is turned off, the axially freely displaceable one-way valve body, like the ball, drops due to the force of gravity onto its valve seat on the side of the first support. As mentioned above, depending on the arrangement of the entire device, the hydraulic medium is retained either under the ball after the principle of a pipette, or above the ball after the principle of a classical one-way valve.

The stop, likewise proposed by the invention for the one-way valve body, serves at the same time as a choke for limiting the flow of hydraulic medium towards the passage on the second support when the internal combustion engine is in operation. For all the solutions proposed herein, the disc can be made, for instance, of a thin-walled, stamped sheet metal part comprising perforations. A variety of configurations are conceivable for these perforations for the flow of hydraulic medium toward the follower member. For example, the stop may comprise leaf spring-like tongues between which through-openings are formed in the direction of the passage. A choking effect for the hydraulic medium is likewise achieved by the fact that the hydraulic medium flows around the one-way valve body.

Alternatively, the stop can also be made out of an extruded part. It is also possible to make the through-openings in the form of inwardly oriented recesses on the outer periphery of the stop.

In a further embodiment of the invention, it is proposed to install a pot-shaped insert comprising the means of the invention in the interior of the tappet pushrod. This renders complex modifications to already existing tappet pushrods superfluous. It can also be of advantage if the insert itself comprises the second support or if it is at least subsequently equipped with this.

As a simple means for limiting the path of movement of the insert into the interior of the tappet pushrod during installation, it is proposed to provide an annular step on a diameter reduction of the interior of the tappet pushrod, against which step an end of the insert comes to abut.

In place of the aforesaid insert, it is also possible to provide two diameter reductions in the tappet pushrod starting from the second support. An annular step of the first diameter reduction then forms a support for the disc that constitutes the stop, and the valve seat is simply formed on a further annular step. The disc can be connected to the interior of the tappet pushrod by simple measures such as a press or clip connection, but also by welding, soldering or the like. What is important is only that the disc remains fixed in position in the tappet pushrod and permits a choked flow of hydraulic medium toward the follower member when the one-way valve body comes to bear against it.

In an alternative solution offered by the invention, the one-way valve body configured, for example, as a ball, can be biased toward its valve seat by a spring means, such as, for example, a coil compression spring. It is understood, that a person skilled in the art will think in this connection of further spring means that can be relatively simply integrated into the tappet pushrod, for example, small leaf springs and the like.

Due to the spring means, the closing action of the one-way valve body after the internal combustion engine is switched off is extremely rapid and independent of the force of gravity. When hydraulic medium pressure is applied, the one-way valve body lifts off against the force of its biasing coil compression spring and permits a choked flow of hydraulic medium over its outer peripheral surface toward the further passage on the follower member.

In a further embodiment of the invention, it is again proposed to install a separate, sleeve-like insert into the interior of the tappet pushrod and to generate the valve seat and a support for the coil compression spring thereon. Due to this insert, the interior of the tappet pushrod can be configured completely without steps. Complex machining measures on the tappet pushrod itself become superfluous. In place of the insert, it is also proposed to provide the interior of the tappet pushrod with at least one annular step on which the valve seat for the one-way valve body, like the ball, is formed. The other end of the coil compression spring can be supported in this embodiment of the invention in a simple manner on an inner end face of the second support configured, for example, as a ball head. It is both conceivable and intended to configure the passage on the second support such that, in this case, too, a choking of the hydraulic medium is effected.

In case a ball is used as a one-way valve body, it is particularly advantageous for achieving a sealing action if the valve seat extends at an angle of 30° to 45°.

The invention will now be described more closely with reference to the appended drawing.

DETAILED DESCRIPTION OF THE DRAWING

Figure 1:
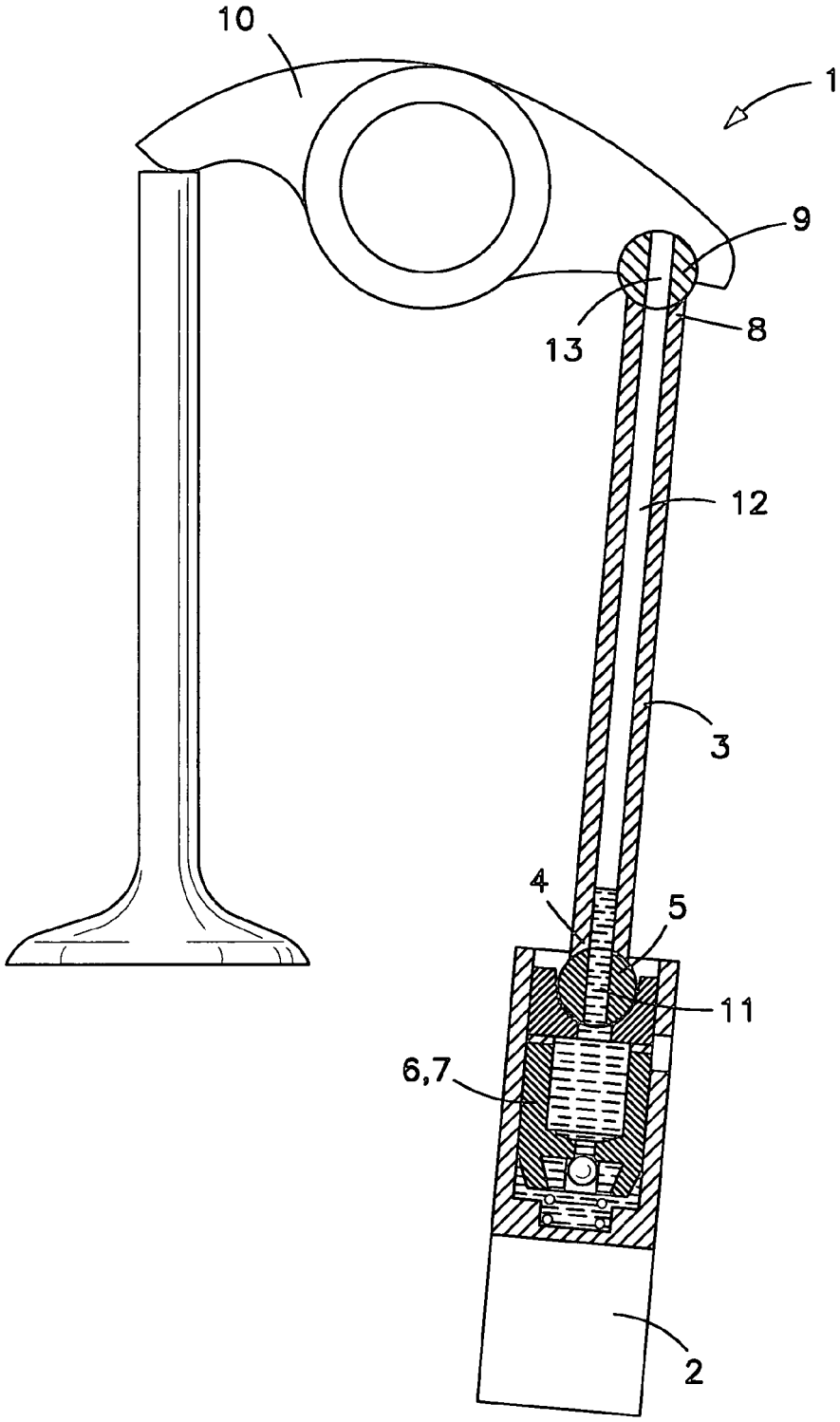
FIG. 1 is a schematic illustration of a valve train comprising a tappet and a tappet pushrod.

FIG. 1 discloses an OHV train comprising a cam-actuated tappet 2 that acts at one end on a hollow tappet pushrod 3. At this end, the tappet pushrod 3 comprises a first support 5 that is configured as a ball head and seated on a pressure piston 6 of a hydraulic lash adjuster 7 of the tappet 2. On its other end 8, the tappet pushrod 3 comprises a second support 9 that is likewise configured as a ball head and acts on a follower member 10 configured as a rocker arm.

The tappet pushrod 3 has a generally hollow configuration, so that hydraulic medium can be routed through its interior 12 to the follower member 10. The hydraulic medium is routed out of the space enclosed by the pressure piston 6, through a first passage 11 in the region of the one end 4 of the tappet pushrod 3, the interior 12 of the tappet pushrod 3 and a second passage 13 in the region of the other end 9, to lubrication points on the follower member 10. FIG. 1 illustrates schematically, a rising hydraulic medium column as is formed upon starting of the internal combustion engine.

As already described above, when the internal combustion engine is turned off, the hydraulic medium column in the pressure piston 6 sinks, under certain circumstances, below an adequate minimum, so that when the engine is re-fired, not enough hydraulic medium for lash adjustment can be re-suctioned into a high pressure chamber of the hydraulic lash adjuster situated therebelow. In the most unfavorable of cases, a re-aspiration of air then takes place.

The aforesaid drawbacks, precisely as can be encountered in the case of very small hydraulic medium reservoirs, e.g. in confined mounting spaces, are avoided through the proposed inventive measures.

Figure 3:
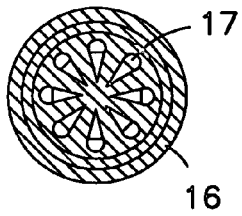
FIG. 3 is a view of a stop for the one-way valve body.
Figure 2:
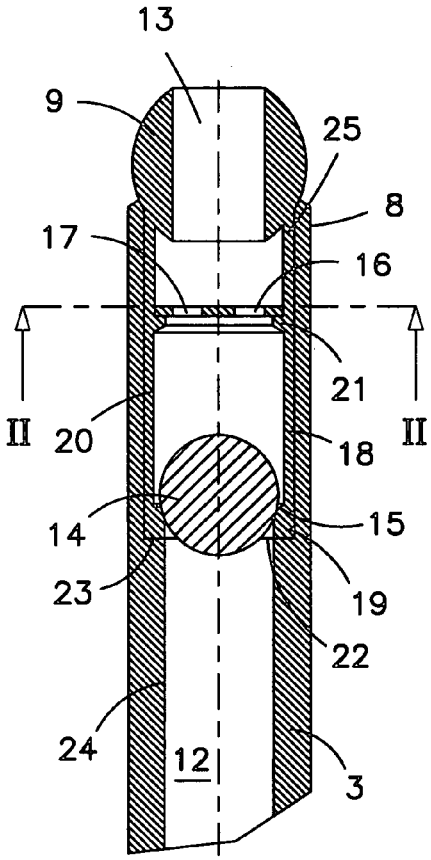
FIG. 2 shows a first embodiment of a tappet pushrod of the invention comprising an axially freely displaceable one-way valve body.
Figure 4:
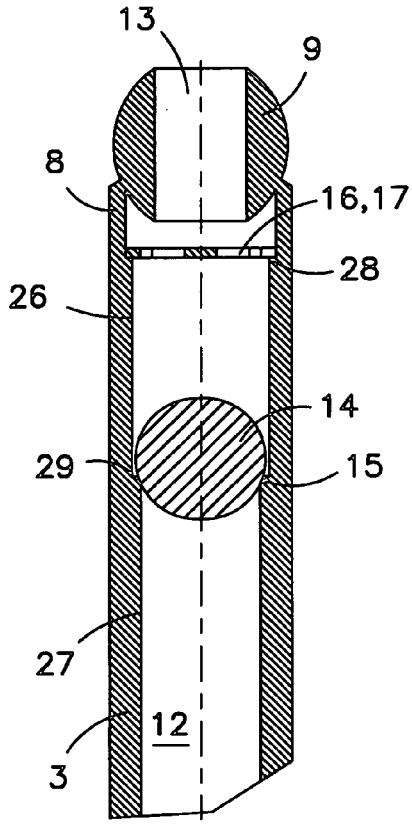
FIG. 4 shows a modification of the first embodiment of the tappet pushrod of the invention comprising an axially freely displaceable one-way valve body.

From FIGS. 2 to 4, it can be seen that a one-way valve body 14, configured in the present case as a ball, is arranged in the interior 12 of the tappet pushrod 3 and extends in the region of the second support 9. The one-way valve body 14 is axially freely displaceable between a complementary valve seat 15 facing the first support 5 and a stop 16, configured as a disc, facing the second support 9. The disc 16, as best seen in FIG. 3, comprises radially extending through-openings 17 and is configured, for instance, as a thin-walled sheet metal part.

It can be seen further in FIG. 2 that a pot-shaped insert 18 is fixed in the interior 12 of the tappet pushrod 3 and seated through its end 22 on an annular step 23 of a diameter reduction 24 of the interior 12 of the tappet pushrod 3. This pot-shaped insert 18 comprises on its other end, the second support 9 comprising the passage 13.

As already mentioned, the valve seat 15 for the one-way valve body 14 is created on an edge region 19 of the insert 18 facing the first support 5. The valve seat 15 advantageously extends at an angle of 30° to 45°, so that a good sealing action is realized when the one-way valve body 14 bears against this seat. The disc-shaped stop 16 in the bore 20 of the insert 18 extends on an annular shoulder 21.

Due to the hydraulic medium pressure prevailing in the interior 12 of the tappet pushrod 3 during normal operation of the internal combustion engine, the one-way valve body 14 is lifted-off and bears against the stop 16 from underneath. Because of the through-openings 17, a choked quantity of hydraulic medium flows over the outer peripheral surface 33 (see also FIGS. 5, 6) of the one-way valve body 14 through the through-openings 17 toward the follower member 10. When the internal combustion engine is turned-off, the one-way valve body 14 drops onto its valve seat 15 due to the force of gravity. As a result, in the embodiments shown in the figures, the hydraulic medium situated under the one-way valve body 14 is retained after the principle of a pipette. A person skilled in the art will use the calculation and designing methods with which he is familiar to configure the tappet pushrod 3 and, if necessary, also the tappet 2 such that the "pipette principle" can be reduced to practice.

As tests have shown, the vibrations that occur when the internal combustion engine is started cause the one-way valve body 14 to lift "rapidly" off its valve seat 15. The "pipette principle" thus becomes ineffective and the accumulated hydraulic medium flows additionally into the reservoir enclosed by the pressure piston 6 and is available for a proper lash adjustment.

If the means provided by the invention is arranged in the region of the first support 5 of the tappet pushrod 3, the hydraulic medium situated above the means can be used after the classical principle of a one-way valve.

FIG. 4 discloses an embodiment similar to that of FIG. 2 but with two diameter reductions 26, 27 in the interior 12 of the tappet pushrod 3. The stop 16 is arranged on an annular step 28 of the first diameter reduction 26. The valve seat 15 for the one-way valve body 14 is formed on a further annular step 29 of the diameter reduction 27. In this way, the aforesaid separate insert 18 can be omitted.

Figure 5:
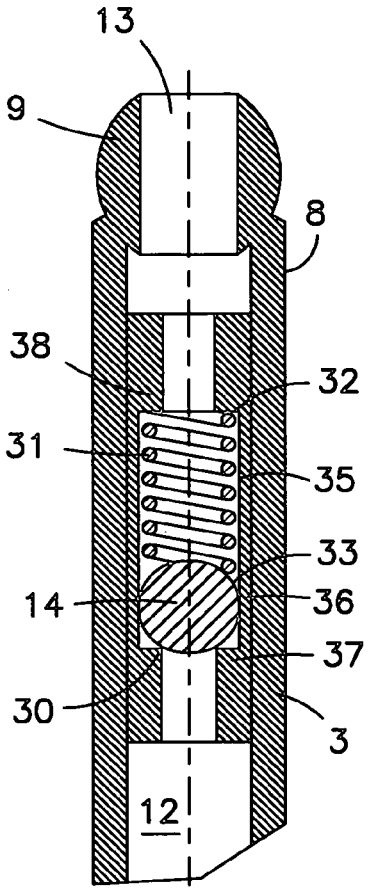
FIG. 5 illustrates an alternative embodiment of the tappet pushrod of the invention, comprising a one-way valve body biased by a compression spring.
Figure 6:
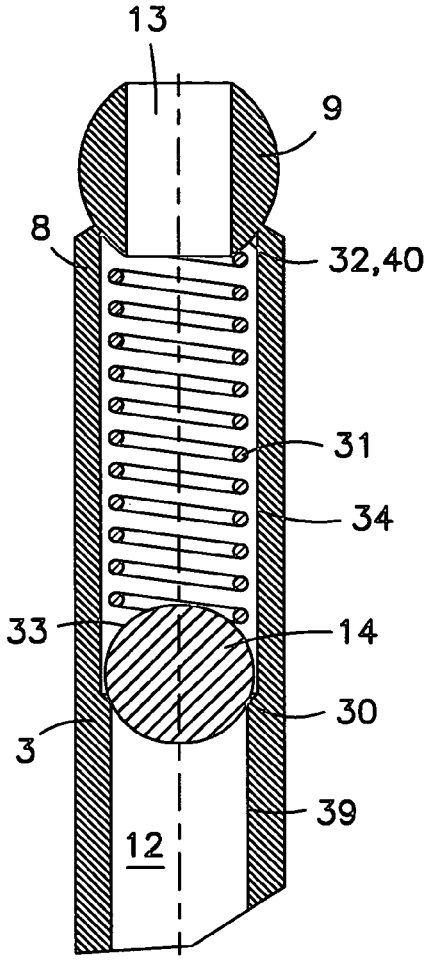
FIG. 6 shows a modification of the embodiment of FIG. 5.

According to FIGS. 5, 6 that show alternative embodiments to the ones already described, the one-way valve body 14 is biased in closing direction by a spring means 31, such as, advantageously, a coil compression spring, so that, among other things, gravitational influences are of no particular importance and the one-way valve body 14 closes particularly rapidly after the internal combustion engine is turned off and no hydraulic medium pressure exists.

According to FIG. 5, a sleeve-shaped component 36 comprising a radially inward directed collar 37, 38 at each end is installed in the interior 12 of the tappet pushrod 3. A valve seat 30 is created on the collar 37, while the inner side of the collar 38 forms a support for the other end of the spring means 31. The component 36 can be made as an extruded part but may also be made as an inexpensive, shaped sheet metal part. A choking of the hydraulic medium stream is achieved in the embodiments of FIGS. 5, 6 by the fact that the hydraulic medium flows around the one-way valve body 14 along its outer peripheral surface 33.

When hydraulic medium pressure is applied, the one-way valve body 14 is lifted off its seat 30 against the force of its spring means 31 and kept, so to speak, in a suspended state. As soon as the internal combustion engine is turned off and hydraulic medium pressure no longer prevails, the one-way valve body 14 is pushed into its valve seat 30 by the spring means 31. The quantity of hydraulic medium that is now situated under the valve seat (in the interior 12) is retained after the principle of a pipette and is available immediately after the starting of the internal combustion engine for an immediate filling of the reservoir enclosed by the pressure piston 6.

In the embodiment of FIG. 6, the separate component 36 (insert) is omitted. Here, too, as described in FIG. 4, the one-way valve body 14 is supported on a valve seat 30 that is created through a diameter reduction 39 of the interior 12 of the tappet pushrod 3.

The invention claimed is:

1. A valve train of an internal combustion engine comprising a tappet and a hollow tappet pushrod that is actuated by said tappet, said tappet pushrod comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod, and the second support comprising a passage for the hydraulic medium to the follower member, wherein a one-way valve body is arranged in the interior of the tappet pushrod and extends for free axial displacement between a complementary valve seat facing the first support and a stop for the one-way valve body, typically a disc, facing the second support, which stop comprises at least one through-opening such that, when the one-way valve body comes to bear against the stop, a choked flow of hydraulic medium takes place toward the second support.

2. A valve train of claim 1, wherein the stop is a disc that is a separate component fixed in the interior of the tappet pushrod, said disc being one of a thin-walled sheet metal part or an extruded part and comprising circumferentially spaced perforations, typically tongue-shaped intermediate spaces, forming through-openings.

3. A valve train of claim 2, wherein a pot-shaped insert is fixed in the interior of the tappet pushrod, the valve seat is formed in one edge region of the insert, the one-way valve body extends directly in the insert, and an annular shoulder is generated axially spaced from the valve seat in a bore of the insert, the disc forming the stop is fixed on the annular shoulder, and an end of the insert oriented toward the interior of the tappet pushrod is localized on an annular step of a diameter reduction of the interior of the tappet pushrod.

4. A valve train of claim 3, wherein, on an end oriented away from the valve seat, the insert comprises the second support that is made as one of integrally with or separately from the insert.

5. A valve train of claim 2, wherein starting from the second support, the interior of the tappet pushrod comprises a first and a second diameter reduction, the disc forming the stop being seated on a first annular step situated near the second support on the first diameter reduction, and the valve seat being formed on a further annular step that follows the first annular step in tappet pushrod direction and is arranged on the second diameter reduction.

6. A valve train of an internal combustion engine comprising a tappet and a hollow tappet pushrod that is actuated by said tappet, said tappet pushrod comprising on one end, a first support for an at least indirectly contacting pressure piston of a hydraulic lash adjuster of said tappet that follows a periodic driving element, typically a cam, a second support for a follower member, typically a rocker arm, being arranged on a further end of the tappet pushrod, said first support comprising a passage for hydraulic medium that can be routed out of the pressure piston during operation of the internal combustion engine into an interior of the tappet pushrod, and the second support comprising a passage for the hydraulic medium to the follower member, wherein a one-way valve body is arranged in the interior of the tappet pushrod and is biased toward a complementary valve seat facing the first support by a spring means, typically at least one coil compression spring, whose further end, proximate to the second support, is supported on a collar projecting into the interior of the tappet pushrod, a choked flow of hydraulic medium taking place between an outer peripheral surface of the one-way valve body and one of the inner peripheral surface of the tappet pushrod or an inner peripheral surface of a component connected to the tappet pushrod which is a sleeve-shaped insert that comprises a radially inward directed collar at each end and is installed in the interior of the tappet pushrod, the one-way valve body extends directly within the component, the valve seat being formed on an inner side of one of the collars and the spring means being supported on the other of the collar.

7. A valve train of claim 6, wherein, at least in a region of insertion of the component, the interior of the tappet pushrod has a smooth surface without steps, and the component is connected to the tappet pushrod by a fixing method, typically pressing-in or shrinkage.

8. A valve train of claim 6, wherein, starting from the second support, the interior of the tappet pushrod comprises a diameter reduction on which the valve seat extends, the spring means is supported directly on one of an inner side of the second support that forms a collar, or a separate stop arranged in a region of the second support.

9. A valve train of claim 1, wherein the one-way valve body is one of a ball, typically a rolling bearing ball, a cylinder or cone tapering toward the first support, or a plate-like element.

10. A valve train of claim 6, wherein the one-way valve body is one of a ball, typically a rolling bearing ball, a cylinder or cone tapering toward the first support, or a plate-like element.

11. A valve train of claim 1, wherein the one-way valve body is a ball and the valve seat extends at an angle of 30°–45°.

12. A valve train of claim 6, wherein the one-way valve body is a ball and the valve seat extends at an angle of 30°–45°.

* * * * *